US005102076A

United States Patent [19]

North et al.

[11] Patent Number: 5,102,076

[45] Date of Patent: Apr. 7, 1992

[54] MAGNETICALLY SUSPENDED PLASTIC BAG DRYER

[76] Inventors: Alan S. North, P.O. Box 9221, Berkely, Calif. 94709; Charles K. Neifeld, 1290 3rd Ave., San Francisco, Calif. 94122

[21] Appl. No.: 549,914

[22] Filed: Jul. 9, 1990

[51] Int. Cl.[5] ..... B65B 67/00

[52] U.S. Cl. ..... 248/95; 211/DIG. 1; 248/206.5; 248/309.4; 248/311.3

[58] Field of Search ..... 248/95, 97, 98, 99, 248/100, 101, 206.5, 683, 311.3, 309.4; 211/DIG. 1, 32, 35; 40/600; 34/239

[56] References Cited

U.S. PATENT DOCUMENTS

| | | | |
|---|---|---|---|
| 2,641,793 | 6/1953 | Wilm | 248/206.5 X |
| 2,964,275 | 12/1960 | Atkinson | 248/206.3 X |
| 3,369,348 | 2/1968 | Davis | 248/95 X |
| 4,258,493 | 3/1981 | Kettlestrings et al. | 40/600 |
| 4,440,430 | 4/1984 | Kruse | 248/95 X |
| 4,575,895 | 3/1986 | Spellman | 248/99 X |
| 4,741,534 | 5/1988 | Rogahn | 40/600 X |
| 4,826,059 | 5/1989 | Bosch et al. | 248/309.4 X |
| 4,846,427 | 7/1989 | Jones | 248/95 |

*Primary Examiner*—David L. Talbott

[57] ABSTRACT

A magnetically suspended rack for drying plastic bags consisting of a magnet attached to a supporting structure. The supporting structure, which can take many forms, can be constructed as a sphere created by two hoops, one inside the other and atttached by rivets so that the inner hoop can rotate on an axis inside the outer hoop.

The support structure with attached magnet is placed inside a wet plastic bag. The said magnet is used to attach the said plastic bag with the said support structure inside to a metal surface. The said support structure holds the said plastic bag open to promote air circulation and consequent drying of the inside of said plastic bag.

1 Claim, 1 Drawing Sheet

MAGNETICALLY SUSPENDED PLASTIC BAG DRYER

FIELD OF INVENTION

This invention relates to drying racks, specifically a mechanism for drying plastic bags.

BACKGROUND OF THE INVENTION

Hitherto there has been no plastic bag drying apparatus utilizing the unique concept employed by this invention. The only other U.S. patent awarded for a plastic bag drying rack is U.S. Pat. No. 3,295,694. This prior art requires a stand which also functions as a catchment tray and requires placement on a horizontal surface. Our invention, by contrast, has no stand, requires no catchment tray and can be suspended magnetically from vertical and overhanging horizontal surfaces.

OBJECT AND ADVANTAGES

Accordingly several objects and advantages of our invention are its ability to hold a wet plastic bag open for air to circulate within and thereby dry, making the re-use of said plastic bag more convenient for plastic bag users, its ability to attach the said plastic bag to vertical and up-side-down overhanging horizontal surfaces while it is drying thus avoiding the need to use counter or table surface area for plastic bag drying, its ability to stick to any ferromagnetic metal surface thus potentially doubling as a message holding refrigerator magnet when not in use as a bag dryer, and its ability to be folded and placed in a drawer for convenient storage when not otherwise in use.

Unlike prior art, this invention uses no tray to collect the negligible amount of water that will drip from the said plastic bag during its drying period.

Further objects and advantages of our invention will become apparent from a consideration of the drawings and ensuing description of it.

LIST OF REFERNCE NUMERALS

Figure 1:
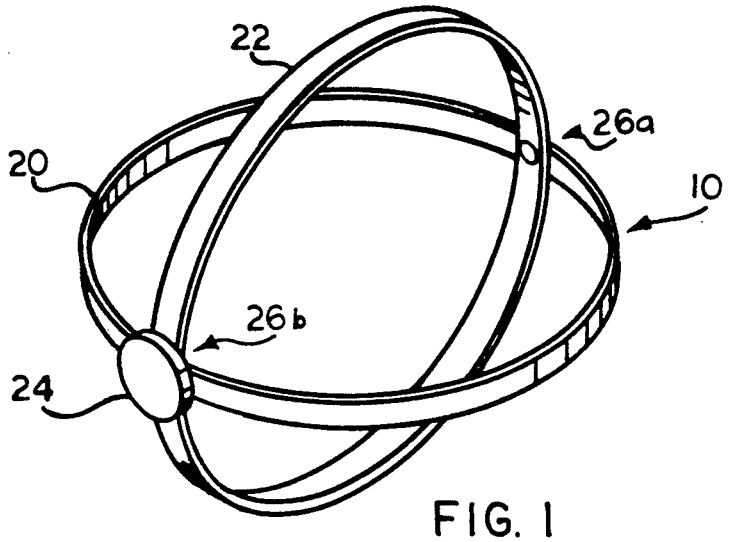
FIG. 1 is an isometric view of our invention.

10 supporting structure
20 outer hoop
22 inner hoop
24 magnet
**24*a*** alternative magnet position
**24*b*** alternative magnet position
**26*a* rivet connection between 20 and 22**
**26*b* rivet connection between 20 and 22**
30 plastic bag
32 plastic bag seam closer
34 plastic bag opening
40 metal surface
**40*a*** metal surface (vertical)

DESCRIPTION OF INVENTION

The magnetically suspended plastic bag dryer is comprised as illustrated in FIG. 1 of a supporting structure 10 and a magnet 24. Our initial design for the supporting structure is comprised of two hoops, 20 and 22, connected by rivets, **26*a* and 26*b*. The magnet 24 is attached to the outer hoop 20**.

Both hoops, 20 and 22, can be made of wood, plastic, metal, bone or other materials. The outer hoop 20 is larger in diameter than the inner hoop 22 such that the inner hoop 22 can easily fit within the area tended by the inner circumference of the outer hoop 20 when they are coplanar. The outer diameter of the inner hoop 22 should be slightly less than the inner diameter of the outer hoop 20.

Figure 2:
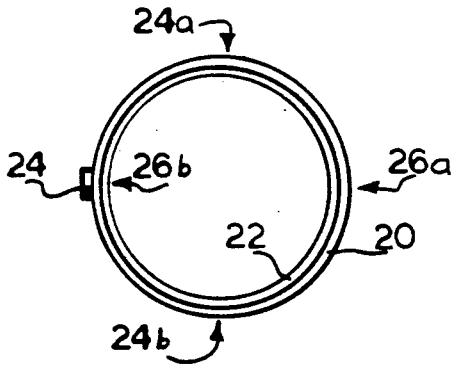
FIG. 2 is a plan view of our invention.

As shown in FIG. 2 the outer hoop 20 and inner hoop 22 are connected by rivets **26*a* and 26*b* such that said rivets 26*a* and 26*b* are placed 180 degrees apart on the circle circumscribed by said hoops 20 and 22 when they are coplanar. The said connecting rivets 26*a* and 26*b* will allow said inner hoop 22 to rotate within the said outer hoop 20**.

As shown in FIG. 2 said magnet 24 is attached to the said outer hoop 20 the same place as said rivet **26*b*. However, said magnet 24 can just as well be attached to said outer hoop 20 at points other than where the said rivets 26*a* and 26*b* are attached to said outer hoop 20 including alternative magnet positions 24*a* and 24*b***.

OPERATION OF INVENTION

As our invention's purpose is to encourage the reuse of plastic bags by providing a method of drying wet plastic bags, presumably the user of our invention will have washed, or at least rinsed, their plastic bags prior to our invention's use.

Figure 3:
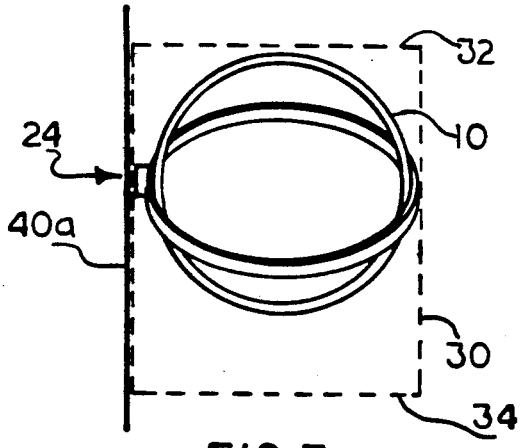
FIG. 3 is a side view of our invention in use and attached magnetically to an overhanging horizontal surface such that the hoops of the supporting structure are open but not fully perpendicular.
Figure 4:
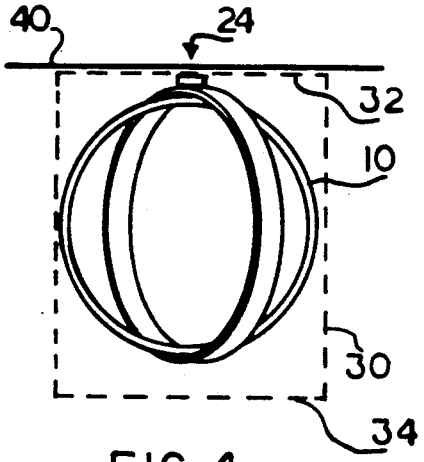
FIG. 4 is a side view of our invention in use and attached magnetically to a vertical surface such that the hoops of the supporting structure are open but not fully perpendicular.
Figure 5:
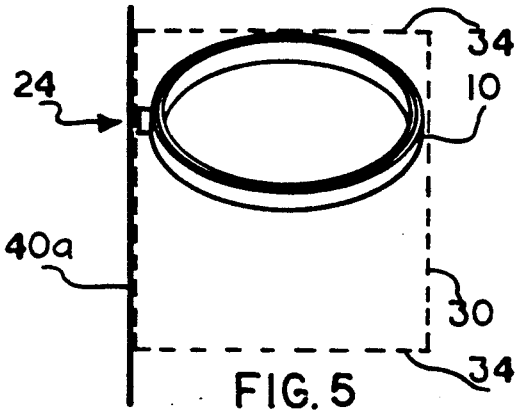
FIG. 5 is a side view of our invention in use and attached magnetically to a vertical surface in an closed state.

Our invention is used by placing it inside a wet plastic bag and using said magnet 24 to attach the said bag to a metal surface 40 or **40*a* as illustrated in FIG. 3, FIG. 4, and FIG. 5**. Our invention will attach the said wet plastic bag to a surface of the user's choice and open the said wet plastic bag for air to circulate and dry it.

FIG. 3 illustrates our invention inside a wet plastic bag 30 as our invention and said bag would be suspended magnetically by our invention from an overhanging horizontal surface. To use our invention to suspend a plastic bag from an overhanging horizontal surface first open said supporting structure 10. Rotate said inner hoop 22 such that the plane defined by the circle of said inner hoop 22 is perpendicular to the plane defined by the circle of said outer hoop 20. Connecting rivets **26*a* and 26*b* will provide an axis for the rotation. With our invention expanded into a spherical shape, place our invention inside the said wet plastic bag 30 such that the magnet 24 is at the plastic bag seam closure 32 and facing away from the plastic bag opening 34. Connect the magnet 24 to a metal surface 40 such that said plastic bag 30 is between said magnet 24 and said metal surface 40. The magnetic attraction between said magnet 24 and said metal surface 40 will hold said plastic bag 30 in place while said supporting structure 10** holds said plastic bag open allowing it to dry.

In the event that the user of our invention does not have an overhanging horizontal metal surface 40 to attract the magnet, one can be created by using a small metal plate (the size of the magnet 24 would be optimal)

attached to whatever overhanging horizontal surface the user would like to dry the plastic bags. An ideal surface could be the underside of a kitchen cabinet above a counter top. The small metal plate which becomes the metal surface 40 can be attached to the overhanging horizontal surface by means of a screw or an adhesive compound.

FIG. 4 illustrates our invention inside a wet plastic bag 30 as our invention and said bag would be suspended magnetically by our invention from a vertical surface. To use our invention with a vertical metal surface 40*a*, first open supporting structure 10. Rotate said inner hoop 22 such that the plane defined by the circle of said inner hoop 22 is perpendicular to the plane defined by the circle of said outer hoop 20. Said connecting rivets 26*a* and 26*b* will provide an axis for the rotation. With our invention expanded into a spherical shape, place our invention inside the said wet plastic bag 30 such that the plane circumscribed by the circle of the outer hoop 20 is parallel with the ground and the plastic bag opening 34 is down and pointing toward the ground. Connect said magnet 24 to said vertical metal surface 40*a* such that said plastic bag 30 is between said magnet 24 and said vertical metal surface 40*a*. The magnetic attraction between said magnet 24 and said vertical metal surface 40*a* will hold said plastic bag 30 in place while the supporting structure holds the said plastic bag open allowing it to dry.

A kitchen refrigerator is an excellent vertical metal surface 40*a* from which to hang and dry plastic bags.

In the event that the user of our invention does not have a vertical metal surface 40*a* to attract the magnet, the user can create one by attaching a small metal plate to an existing vertical surface as described above.

FIG. 5 illustrates our invention inside a wet plastic bag 30 and suspending the said bag containing our invention from a vertical surface without opening our invention into a spherical shape. When our invention is used in conjunction with a vertical metal surface 40*a*, opening our invention into a sphere is not always necessary. The circular nature of a single hoop of said supporting structure 10 is often enough to keep said plastic bag 30 open allowing for air circulation and commensurate drying.

In its folded form our invention stores easily in a draw or attached to any metal surface.

CONCLUSION AND SCOPE OF INVENTION

Thus the reader will see that the magnetically suspended plastic bag dryer of our invention will be a handy way of drying plastic bags. Placing our invention inside a wet plastic bag makes it easy to attach said bag to any ferromagnetic metal surface while the supporting structure part of our invention holds the bag open for air circulation to promote drying.

While our above description contains may specificities, these should not be construed as limitations on the scope of the invention, but rather as an exemplification of one preferred embodiment thereof. Many other variations are possible. For example the hoops could be made out of a variety of material including, but not limited to, wood, plastic, metal, clay, bone, cartilage or many other solid materials including combinations of materials. This shape of the supporting structure could be spherical, elliptical, square, rectangular, or any other polygons or abstract shape. The hoops or othershaped supporting structure used to hold the bag open may be of fixed shape or jointed for easy collapsibility. Supporting structure constructions may employ the use of rivets or other joining materials and or processes including, but not limited to, adhesive compounds, screws and other methods of joining materials. The magnet can be of any size and shape. The size of our invention may vary as needed to fit inside the bag it will be intended for drying. Accordingly, the scope of the inventions should be determined not by the embodiments illustrated, but by the appended claims and their legal equivalents.

We claim:

1. A magnetically suspended rack for holding bags open as a means of promoting the drying of said bags comprising:

(a) a bag, (b) a three dimensional support frame for holding said bag open by its placement inside said bag to maintain airflow in and around said bag, and (c) a magnet providing a means of suspending said bag by holding it to any ferromagnetic metal surface wherein magnetic bonding between said magnet and said ferromagnetic metal surface occurs through the wall of said bag.

* * * * *